United States Patent [19]

Shutt

[11] 4,131,785

[45] Dec. 26, 1978

[54] ELECTRICALLY HEATED LIQUID TANK EMPLOYING HEAT PIPE HEAT TRANSFER MEANS

[75] Inventor: James R. Shutt, Reston, Va.

[73] Assignee: Electro-Therm, Inc., Laurel, Md.

[21] Appl. No.: 659,071

[22] Filed: Feb. 18, 1976

[51] Int. Cl.[2] ..... H05B 3/82; F24H 1/20; F28D 13/00

[52] U.S. Cl. ..... 219/326; 122/33; 126/360 R; 126/361; 165/105; 219/302; 219/306; 219/310; 219/316; 219/335; 219/336; 219/341; 219/523; 219/530; 219/540

[58] Field of Search ..... 219/325, 306, 326, 310, 219/312, 315, 316, 318, 335, 336, 341, 365, 378, 523, 530, 540, 302; 165/105, 104, 132; 122/32–34; 126/360, 361

[56] References Cited

U.S. PATENT DOCUMENTS

| | | | |
|---|---|---|---|
| 1,167,894 | 1/1916 | Fowler | 219/341 UX |
| 1,748,510 | 2/1930 | Forman | 219/540 X |
| 2,014,803 | 9/1935 | Hakansom | 219/325 |
| 2,237,054 | 4/1941 | Jensen | 219/341 UX |
| 2,763,763 | 9/1956 | Cunningham | 219/336 |
| 2,835,480 | 5/1958 | Perez | 219/326 UX |
| 2,992,313 | 7/1961 | Taylor | 219/341 UX |
| 3,468,300 | 9/1969 | Geyer et al. | 165/105 X |
| 3,854,454 | 12/1974 | Lazaridis | 165/105 X |
| 3,889,096 | 6/1975 | Asselman et al. | 219/341 UX |
| 3,947,244 | 3/1976 | Lazaridis | 165/105 |

FOREIGN PATENT DOCUMENTS

| | | | |
|---|---|---|---|
| 559201 | 9/1932 | Fed. Rep. of Germany | 219/326 |
| 2164674 | 12/1971 | Fed. Rep. of Germany | 219/325 |
| 2433790 | 1/1976 | Fed. Rep. of Germany | 219/335 |
| 372342 | 4/1932 | United Kingdom | 219/341 |

*Primary Examiner*—A. Bartis

*Attorney, Agent, or Firm*—Henry W. Collins; Richard G. Kinney; Thomas R. Vigil

[57] ABSTRACT

The heating apparatus for applying heat to the interior of a chamber includes a modular, removable, electrical, heat-producing unit and a heat pipe mountable in a wall of the chamber with one end of the pipe arranged to receive heat from the electrical heat producing unit exterior of the housing and with another end of the pipe constructed and arranged to apply heat to the medium within the chamber. The heat pipe has high conductivity with a low temperature differential between the ends thereof and the heat producing unit includes an electric coil positioned about and removably secured to the one end of the heat pipe. The electric coil is embedded in a high thermal conductivity, low electrical conductivity filler material which is surrounded by a low thermal conductivity insulating jacket and which is received around a metal core member which is removably secured to the one end of the heat pipe.

24 Claims, 8 Drawing Figures

HEAT PIPE 187
LOW THERMAL CONDUCTIVITY FILLER
HIGH THERMAL CONDUCTIVITY ELECTRICAL INSULATION 39

ELECTRICALLY HEATED LIQUID TANK EMPLOYING HEAT PIPE HEAT TRANSFER MEANS

BACKGROUND OF THE INVENTION

This invention relates generally to improvements in heating apparatus, and more particularly to heating apparatus utilizing a heat transfer member, such as a heat pipe, for heating a liquid in a chamber or storage container.

Heretofore, heating apparatus utilized to heat the interior of a chamber or tank of a heater assembly, such as in a hot water heater or in a hemodialysis device, and the like, included a combined heat producing and heat transfer element. In some instances the heating apparatus was built into the heater assembly such that a failure of the heating apparatus or any of its associated components required that the entire heater assembly be discarded. For example, in some presently available, domestic electric hot water heaters, the heating element is secured permanently within the tank. This type of hot water heater is relatively reliable for long periods of time. However, should a malfunction occur, it may require that the entire hot water heater be discarded and replaced or a major overhaul of the heater may be required. Furthermore, heating elements are generally of a fixed heat capacity type. If additional heat is required, a different, larger capacity heating element is required. This frequently requires that the entire heater assembly, including the tank, be replaced.

Additionally, in presently available hot water heaters, such as those wherein the heating element is mounted in the wall of the tank, if the heating element needs to be replaced, it is necessary to drain the water from the tank to permit removal of the heating element therein. Still another problem with electrical hot water heaters, and the like, is that of a possibility of an electrical short circuit. This may be hazardous to persons using or repairing the hot water heater.

As will be described in detail hereinafter, the present invention provides an improvement over previously proposed heating apparatus by separating the heat-producing function from the heat-transfer function in a heating apparatus utilized for heating a medium in a chamber or storage container, e.g. a water tank. Preferably, the heat-transfer function is achieved with a heat pipe.

Heretofore it has been proposed to utilize a heat pipe in a fossil fuel fired hot water heater as disclosed in U.S. Pat. No. 3,854,454. As will be apparent from the following description, the present invention differs from the heat pipe water heater disclosed in this patent. In particular, and as more fully described hereinafter, the heating apparatus of the present invention has a novel modular design and construction and is primarily designed and constructed for use in an electric heating device, such as in an electric hot water heater or in a hemodialysis device.

SUMMARY OF THE INVENTION

According to the invention, there is provided a heating apparatus for applying heat to the interior of a substantially closed container containing a liquid therein to be heated and comprising a modular, removable heat transfer member having a heat absorbing end and a heat transmitting end and having high conductivity with a low temperature differential between the ends thereof.

Mounting means are provided for removably mounting said heat transfer member on the exterior wall surface of a container with said heat absorbing end positioned exterior of the container and said heat transmitting end positioned to apply heat to the liquid within the container. A modular, removable, electrical heat producing means including an electric heating coil is positioned about and removably secured to said heat absorbing end of said heat transfer member exterior of the container, whereby said heat transfer member and said heat producing means can be removed from the container and replaced. The electric heating coil is embedded in a high thermal conductivity, low electrical conductivity filler material which is surrounded by a low thermal conductivity insulating jacket and which is received around a metal core member which is removably secured to said heat absorbing end of said heat transfer member.

Also according to the invention there is provided a heater comprising a substantially closed chamber for receiving a liquid to be heated therein. A modular, removable heat transfer member having a heat absorbing end and a heat transmitting end having high conductivity with a low temperature differential between the ends thereof, is removably secured to a wall of said chamber with said heat transmitting end positioned exterior of said chamber and said heat transmitting end positioned to heat the interior of said chamber. A mounting means is provided for removably mounting said heat transfer member to an exterior wall surface of said chamber, and a modular, removable, electrical heat producing means including electric heating coil is positioned about and removably secured to said heat absorbing end of said heat transfer member exterior of said chamber, whereby said heat transfer member and said heat producing means can be removed from said chamber. The electric heating coil is embedded in a high thermal conductivity, low electrical conductivity filler material which is surrounded by a low thermal conductivity insulating jacket and which is received around a metal core member which is removably secured to said heat absorbing end of said heat transfer member.

DESCRIPTION OF THE PREFERRED EMBODIMENTS

Figures 1, 2, 7, 8:
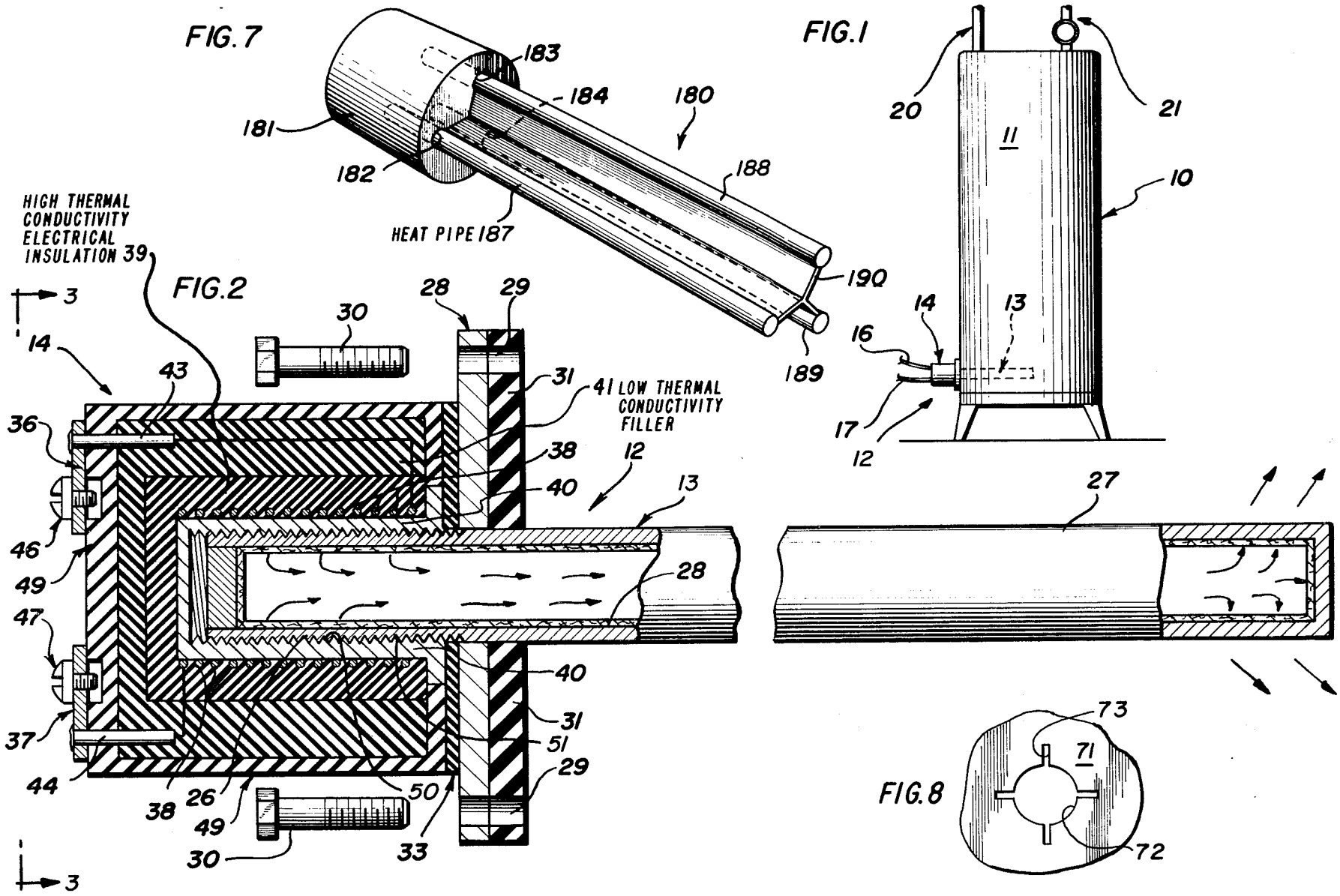
FIG. 1 is an elevational view of a hot water heater utilizing a heating apparatus constructed according to the teachings of the present invention.
FIG. 2 is an enlarged partially sectional view of the heating apparatus shown in FIG. 1.
FIG. 7 is a perspective view of still another alternate embodiment of a heating apparatus constructed in accordance with the teachings of the present invention and including a plurality of heat transfer members interconnected by a web which may be perforated for improved fluid movement, and is shown with FIGS. 1 and 2 on the first sheet of drawings.
FIG. 8 is a fragmentary vertical view taken along line 8—8 of FIG. 4 and shows the shape of the opening in the side of the water tank for receiving the heating apparatus shown in FIG. 4.

Referring now to FIG. 1, there is illustrated therein a heater assembly designated generally by reference numeral 10 and including a storage container or tank 11 and a heating apparatus 12. In the illustrated embodiment the heater assembly 10 is shown as an electric hot water heater, but it will be understood that other heater assemblies, such as in a hemodialysis device, may use the teachings of the present invention.

The heating apparatus 12 is constructed in accordance with the teachings of the present invention and includes a heat transfer member 13 having one end thereof positioned within the interior of the hot water tank 11 and in direct contact with the water or other medium to be heated. Most advantageously, an electric heating unit 14 is secured to the other end of the heat transfer member 13 exterior of the hot water tank 11. The heating unit 14 is electrically operated via a pair of electrical leads 16 and 17 adapted to be connected to a suitable source of operating voltage. In the illustrative embodiment the heater 14 is operated from a conventional line source such as a 60 cycle 120 volt alternating current source.

The hot water tank 11 includes an inlet 20 to receive cold water and an outlet 21 through which hot water is delivered through suitable pipes connected thereto.

The details of construction of the heating apparatus 12 of the invention are illustrated in FIG. 2. As shown therein the heating apparatus 12 includes the heat transfer member 13 which has a heat absorbing end 26 and a heat transmitting or radiating end 27 and the electric heating unit 14. The heat transfer member 13 is of conventional design and is commonly referred to as a heat pipe. The heat pipe 13 may include a wick or other medium 28 typically along its interior walls, which has a quantity of working fluid saturated therein. The working fluid may be any suitable liquid, such as water, freon, methyl alcohol, acetone, etc.

Briefly, a heat pipe functions as a very efficient device for transferring heat from a first location, i.e. from a heat source, to a second location at a slightly lower temperature with a very small temperature difference between the ends of the pipe. A heat pipe is generally considered a closed-loop two cycle system. The phase of operation includes a rapid heat transfer into the pipe resulting in evaporation of a working fluid therein. The evaporated working fluid is then transmitted along the pipe and condensed at the other end thereof. The cycle is completed by the returning of the condensate to the evaporating end by means of capillary or other action through a wick or other suitable means within the pipe.

The heating apparatus 12 also includes a mounting flange 28 having a plurality of apertures 29 formed therein. The apertures 29 are adapted to receive fasteners 30. The fasteners 30 are herein illustrated as bolts, but it will be understood that other fasteners, such as rivets or sheet metal screws, may be utilized. To provide a fluid-tight seal about an opening formed in the hot water tank 11, a resilient pad or gasket 31 is positioned over the flange 28. An insulator pad 33 is positioned on the other side of the flange 28 and provides thermal insulation between the heating unit 14 and the flange 28.

The heating unit 14 includes terminal bars 36 and 37 which are electrically connected to opposite ends of a heating wire 38. Preferably, the major portion of the heating wire is embedded within a high thermal conductivity, electrically insulative, filler material 39 which, in the illustrated embodiment, is located about a threaded central metal core member 40. Outwardly of the high-conductivity filler material 39 is a low thermal and electrical conductivity filler material 41 through which the terminating ends of the heating wire 38 pass. One end of the heating wire 38 is connected to the terminal 36 through a terminal post 43 while the other end of the heating wire 38 is connected to terminal 37 through a terminal post 44. Electrical connection to the heating wire 38 is made by a pair of screw contacts 46 and 47. The entire heating unit 14 is encased in a housing 49, preferably of very effective electrical insulating material.

Most advantageously, the core member 40 is provided with threads 50 and the heat-receiving end 26 of the heat transfer member (heat pipe) 13 is provided with corresponding threads 51. The heating unit 14, therefore, can be readily fastened to and removed from the heat absorbing end of the heat pipe 13 without requiring that the heat pipe 13 be removed from the hot water heater 10, or other heating vessel.

From the foregoing description of one embodiment of the heating apparatus 12 of the present invention, it will be apparent that it is of modular design with the heat transfer member 13 comprising one module and the heating element 14 comprising another module. With this construction, either module can be easily removed and replaced without replacement of the other module. Also, the module, i.e. the heating unit 14, having critical, high failure components, is positioned exteriorly of the water tank 11, thereby permitting replacement of same without draining the water tank.

Figure 4:
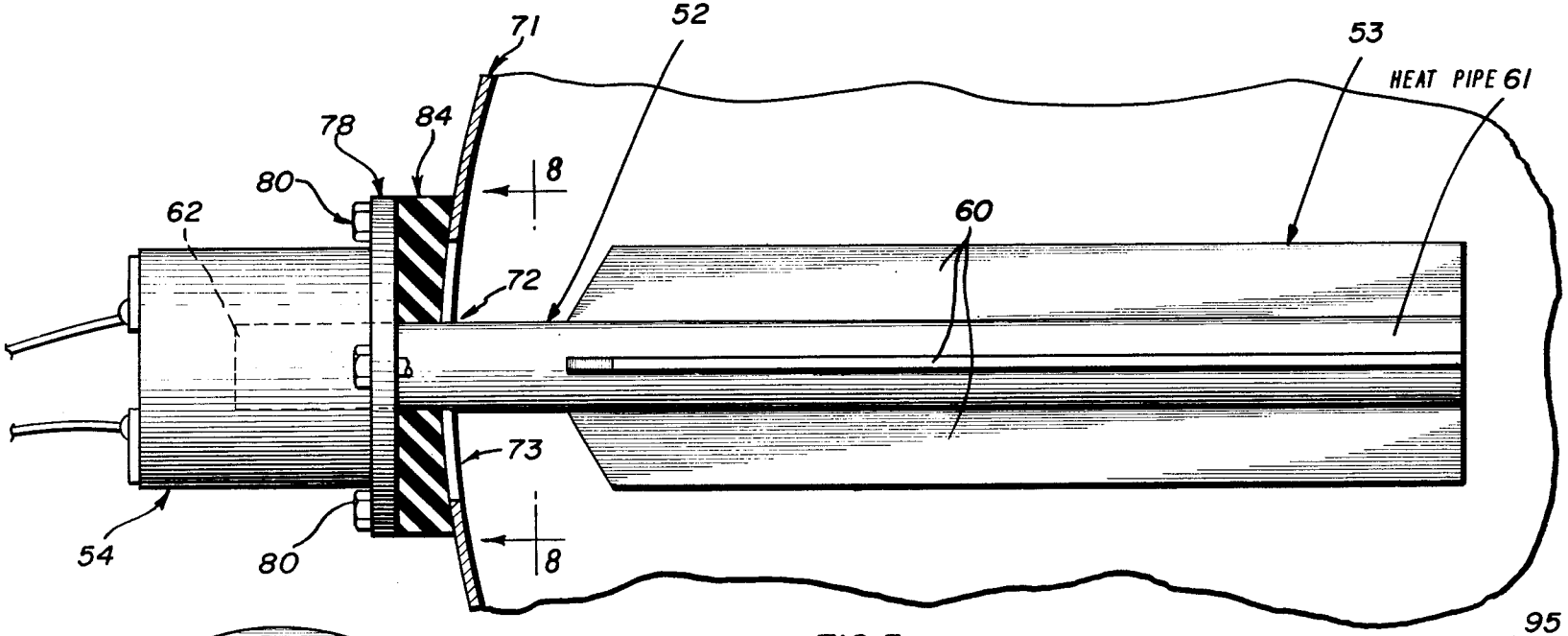
FIG. 4 is a top view of an alternate embodiment of a heating apparatus constructed in accordance with the teachings of the present invention.
Figure 3:
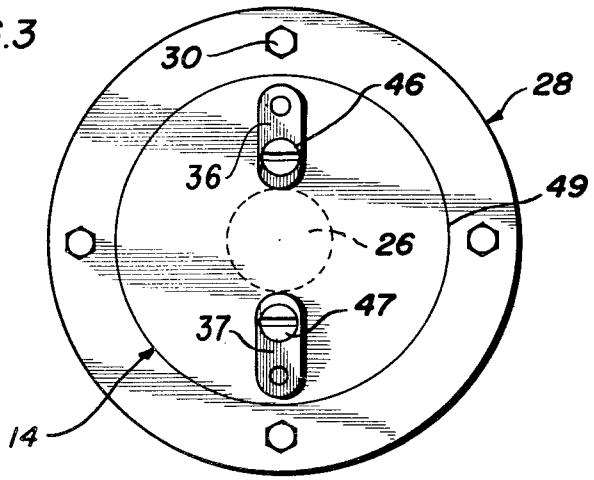
FIG. 3 is an end view of the heating apparatus shown in FIG. 2 and is taken along line 3—3 of FIG. 2.

Referring now to FIG. 4 there is illustrated therein an alternate embodiment of the heating apparatus constructed in accordance with the teachings of the present invention and generally identified by the reference numeral 52. The heating apparatus 52 includes a heat transfer member 53 and a heating unit 54. As shown, the heat transfer member 53 has a plurality of longitudinal and/or radially outwardly directed radiating fins 60 secured to the heat radiating end 61 thereof. A heat absorbing end 62 is positioned with the heating unit 54 substantially in the same manner as unit 14 is positioned in FIGS. 1, 2 and 3. A fragmentary wall portion 71 of a water tank is illustrated and includes an opening 72 through which the heat transfer member 53 is inserted. The opening includes slots 73 plurally located to conform substantially to the position of the radiating fins 60. Therefore, the heat transfer member 53 can be inserted through the wall 71 and secured in place by a flange 78 with fasteners 80. A resilient pad 84 is positioned between the flange 78 and the wall 71 and is sufficiently resilient to conform as necessary to the contour of the wall, as best seen in FIG. 4.

Figure 6:
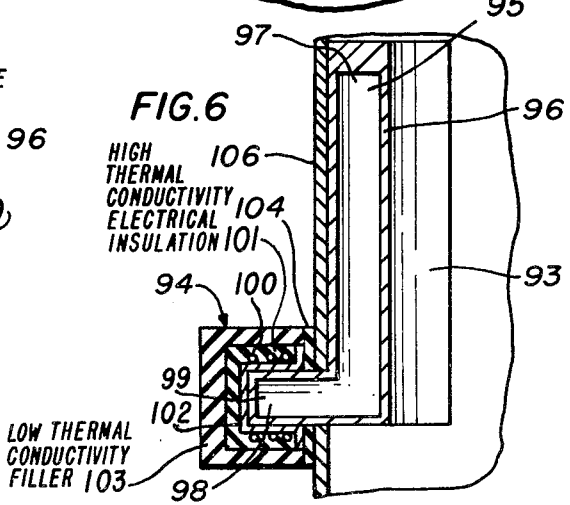
FIG. 6 is a sectional view taken along line 6—6 of FIG. 5.
Figure 5:
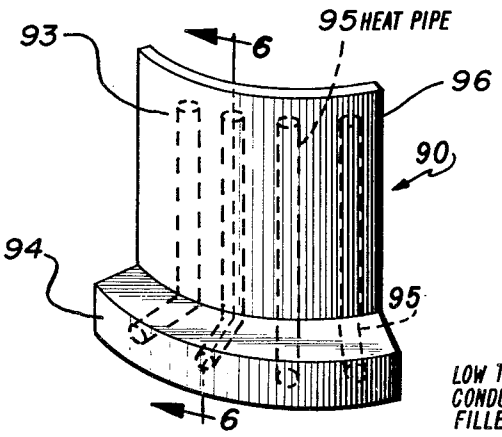
FIG. 5 is a perspective view of another alternate embodiment of a heating apparatus constructed in accordance with the teachings of the present invention.

Referring now to FIGS. 5 and 6, there is illustrated therein another alternate embodiment of a heating apparatus constructed in accordance with the teachings of the present invention and designated generally by the reference numeral 90. The heating apparatus 90 includes a curved plate-like heat transfer member 93 and a C-shaped heating unit 94. As shown in FIG. 6 the heat transfer member 93 has an L-shaped cross section and has a plurality of L-shaped heat pipes 95 therein. With this construction the heat transfer member 93 has an upper section 96 with a heat transferring or radiating end 97 and a lower section 98 having a heat absorbing end 99. The upper section 96 forms the upper leg of the "L" and the lower section 98 forms the short leg of the "L", as shown in FIG. 6.

The C-shaped heating unit 94 has a U-shaped cross section as shown in FIG. 6, the bight of the "U" fitting about the lower section 98 of the heat transfer member 93. The heating unit 94 is similar in construction to the heating unit 14 in that it includes a heating wire 100 embedded within a high thermal conductivity sleeve 101 situated about a central metal core member 102 positioned about the heat absorbing end 99 of the transfer member 93. A low thermal conductivity jacket 103 surrounds the sleeve 101.

Additionally, the heating apparatus 90 includes an insulating gasket 104 positioned between the heating unit 94 and a wall 106 of a container or vessel. The heating unit 94, of course, is secured to the wall 106 by suitable fasteners not shown.

With the above-described construction the heating apparatus 90 is readily adaptable for mounting to the curved outer or inner wall surface of the heating vessel, such as a hot water tank or a hemodialysis device, with the lower section 98 extending through a slot in the wall of the vessel.

Referring now to FIG. 7, there is illustrated therein still another alternate embodiment of a heating apparatus constructed in accordance with the teachings of the present invention. In this embodiment, the heating apparatus is generally designated by the reference numeral 180 and includes a cylindrical heating unit 181 preferably of the type which is electrically energized. A plurality of apertures 182, 183 and 184 extend into the heating unit from one end thereof, all the apertures being located equidistantly from each other about a common center point. Fitted into each of the apertures 182, 183 and 184 and extending outwardly from the heating unit 181 are a multiplicity of, e.g., three heat pipes 187, 188 and 189. Preferably, and as shown in FIG. 7, the three heat pipes 187, 188 and 189 are interconnected by an elongate web 190 having an appropriate, e.g., a "Y", cross section. The web 190 may be perforated to improve fluid flow and provides a heat radiating surface to enhance transfer of heat from the heat pipes 187–189 to the liquid medium in which they are submersed.

With the construction described above the heat transfer member of the heating apparatus 180 consists of the three heat pipes 187–189 and the interconnecting web 190. As with the other embodiments, the heat transfer member is easily separable from the heating unit 181 and is preferably mounted within a vessel or container by means of a suitable flange and sealing gasket, not shown, to permit easy removal and replacement of the heating unit 181.

From the foregoing description of several embodiments of the heating apparatus of the present invention, it will be apparent that the disclosed heating apparatus has a number of advantages, some of which have been described above and others of which are inherent in the invention. In this respect an important advantage of the invention is the provision of a modular, readily removable heating unit which can be easily replaced when defective or when a larger heat capacity heating unit is desired. Also from the foregoing description it will be understood that obvious modifications and variations can be made to the apparatus of the invention without departing from the teachings of the invention. For example, the heat transfer member can take various configurations as is apparent from the various embodiments described above and illustrated in the drawings.

Also, for example, the heat transfer member can be press-fitted, welded, brazed, soldered, or otherwise secured into an opening in the wall of a container instead of being secured therein by means of a flange and fasteners and the heating unit can be press-fitted about the heat absorbing end of the heat transfer member positioned exteriorly of the container.

Accordingly, the scope of the invention is only to be limited as necessitated by the accompanying claims.

I claim:

1. A heating apparatus for applying heat to the interior of a substantially closed container containing a liquid therein to be heated, comprising: a modular, removable heat transfer member having a heat absorbing end and a heat transmitting end and having high conductivity with a low temperature differential between the ends thereof, mounting means for removably mounting said heat transfer member on the exterior wall surface of a container with said heat absorbing end positioned exterior of the container and said heat transmitting end positioned to apply heat to the liquid within the container, and modular, removable, electrical heat producing means including an electric heating coil positioned about and removably secured to said heat absorbing end of said heat transfer member exterior of the container, whereby said heat transfer member and said heat producing means can be removed from the container and replaced, said electric heating coil being embedded in a high thermal conductivity, low electrical conductivity filler material which is surrounded by a low conductivity insulating jacket and which is received around a metal core member which is removably secured to said heat absorbing end of said heat transfer member.

2. The heating apparatus according to claim 1, wherein said mounting means includes a flange which is secured to said heat transfer member intermediate said heat absorbing end and said heat transmitting end, said heat transmitting end adapted to be inserted into the container through an opening formed in the wall thereof to place said heat transmitting end in direct contact with the medium within the container, and wherein said heat producing means is removably secured to said heat absorbing end of said heat transfer member so as to be removable therefrom while said heat transfer member remains secured to the container.

3. The heating apparatus according to claim 2, wherein said heat transfer member is a heat pipe having a working fluid therein, said working fluid being evaporated at said heat absorbing end and condensed at said heat transmitting end, and means within said heat pipe for returning the condensed working fluid at said heat transmitting end back to said back absorbing end where said working fluid is again evaporated.

4. The heating apparatus according to claim 2 further including radiating means secured to said transmitting end of said heat transfer member to increase the surface area of said radiating end and increase the heat transfer rate thereof.

5. The heating apparatus according to claim 2, wherein said mounting means includes a resilient member which forms a fluid-tight seal with the wall of the container about the opening formed therein, said heat transmitting end of said heat transfer member being inserted through the opening to be in direct contact with the medium to be heated.

6. The heating apparatus according to claim 1, wherein said heat absorbing end of said heat transfer member is threaded and said core member includes a matching threading so as to be threadably secured about the heat absorbing end of said heat transfer member.

7. The heating apparatus according to claim 1, wherein said heat transfer member comprises a plurality of spaced apart heat pipes each having their heat absorbing ends aligned with one another at one end of said heat transfer member and their heat transmitting ends aligned with one another at the opposite end of said heat transfer member.

8. The heating apparatus according to claim 7, wherein said heat transfer member has a curved, plate-like configuration with an L-shaped cross section and with said heat pipes being situated therein and having an L-shape, and wherein said heat producing means is C-shaped with a U-shaped cross section, the bight of the "U" fitting about one leg of the "L" containing said heat absorbing ends of said heat pipes.

9. The heating apparatus according to claim 7, wherein said heat transmitting ends of said heat pipes are secured together by an elongate web.

10. The heating apparatus according to claim 7, wherein said heat producing means has a plurality of openings for receiving said heat absorbing ends of said heat pipes.

11. The heating apparatus according to claim 1, wherein said heat producing means is press-fitted on and about said heat absorbing end of said heat transfer member.

12. A heater comprising: a substantially closed chamber for receiving a liquid to be heated therein, a modular, removable heat transfer member having a heat absorbing end and a heat transmitting end and having high conductivity with a low temperature differential between the ends thereof, said heat transfer member being removably secured to a wall of said chamber with said heat absorbing end positioned exterior of said chamber and said heat transmitting end positioned to heat the interior of said chamber, mounting means for removably mounting said heat transfer member to an exterior wall surface of said chamber, and modular, removable, electrical heat producing means including an electric heating coil positioned about and removably secured to said heat absorbing end of said heat transfer member exterior of said chamber, whereby said heat transfer member and said heat producing means can be removed from said chamber, said electric heating coil being embedded in a high thermal conductivity, low electrical conductivity filler material which is surrounded by a low thermal conductivity insulating jacket and which is received around a metal core member which is removably secured to said heat absorbing end of said heat transfer member.

13. The heater according to claim 12, wherein said mounting means includes a flange which is secured to said heat transfer member intermediate said heat absorbing end and said heat transmitting end, said heat transmitting end being inserted into said chamber through an opening formed in the wall thereof to place said heat transmitting end in direct contact with the medium within said chamber, and said heat producing means is removably secured to said heat absorbing end of said heat transfer member so as to be removable therefrom while said heat transfer member remains secured to the wall of said chamber.

14. The heater according to claim 13, wherein said heat transfer member is a heat pipe having a working fluid therein, said working fluid being evaporated at said heat absorbing end and condensed at said heat transmitting end, and means within said heat pipe for returning the condensed working fluid at said heat transmitting end back to said heat absorbing end where said working fluid is again evaporated.

15. The heater according to claim 13, further including radiating means secured to said transmitting end of said heat transfer member to increase the surface area of said radiating end and increase the heat transfer rate thereof.

16. The heater according to claim 13, wherein said mounting means includes a resilient member to form a fluid-tight seal with the wall of said chamber about the opening formed in the wall thereof, said heat radiating end of said heat transfer member being inserted through said opening to be in direct contact with the medium to be heated.

17. The heater according to claim 12, wherein said heat absorbing end of said heat transfer member is threaded and said core member includes a matching threading so as to be threadably secured about the heat absorbing end of said heat transfer member.

18. The heater according to claim 12, wherein said heat transfer member comprises a plurality of spaced apart heat pipes each having their heat absorbing ends aligned with one another at one end of said heat transfer member and their heat transmitting ends alinged with one another at the opposite end of said heat transfer member.

19. The heater according to claim 18, wherein said heat producing means has a plurality of receptacles for receiving the heat absorbing ends of said heat pipes.

20. The heater according to claim 18, wherein the heat transmitting ends of said heat pipes are secured together by an elongate web.

21. The heater according to claim 18, wherein said heat transfer member has a curved, plate-like configuration with an L-shaped cross section and with said heat pipes being situated therein and having an L-shape, and wherein said heat producing means is C-shaped with a U-shaped cross section, the bight of the "U" fitting about one leg of the "L" containing said heat absorbing ends of said heat pipes.

22. The heater according to claim 12 being a hot water heater and wherein said chamber is a hot water tank.

23. The heater according to claim 12 being a part of a hemodialysis device and wherein said chamber is a component thereof.

24. The heater according to claim 12 wherein said heat producing means is press-fitted on and about said heat absorbing end of said heat transfer member.

* * * * *

UNITED STATES PATENT AND TRADEMARK OFFICE

CERTIFICATE OF CORRECTION

PATENT NO. : 4,131,785

DATED : December 26, 1978

INVENTOR(S) : James R. Shutt

It is certified that error appears in the above-identified patent and that said Letters Patent are hereby corrected as shown below:

Column 6, line 35, after "low" insert -- thermal -- .

Column 6, line 57, after "said" delete "back" and insert -- heat -- .

Column 8, line 37, after "ends" delete "alinged" and insert -- aligned -- .

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*